United States Patent [19]

Wiene

[11] 4,110,388

[45] Aug. 29, 1978

[54] METHOD AND A MOULD FOR PRODUCING AN INSULATING UNIT, IN PARTICULAR A BUILDING UNIT

[75] Inventor: Ole Wiene, Farum, Denmark

[73] Assignee: Permataet Kobenhavn A/S, Bagsvaerd, Denmark

[21] Appl. No.: 781,518

[22] Filed: Mar. 25, 1977

[30] Foreign Application Priority Data

Mar. 31, 1976 [DK] Denmark ..... 1495/76

[51] Int. Cl.[2] ..... B28B 1/08

[52] U.S. Cl. ..... 264/71; 249/121; 249/141; 264/128; 264/263; 264/275; 264/278; 264/DIG. 6

[58] Field of Search ..... 264/71, 128, 263, 275, 264/278, DIG. 6; 249/121, 141; 425/817 R

[56] References Cited

U.S. PATENT DOCUMENTS

| | | | |
|---|---|---|---|
| 2,194,036 | 3/1940 | Talalay | 264/128 X |
| 2,903,389 | 9/1959 | Fujita | 264/128 X |
| 3,247,294 | 4/1966 | Sabouni | 52/612 X |
| 3,608,010 | 9/1971 | Stayner | 264/128 X |
| 3,787,544 | 1/1974 | Barnette | 264/278 X |
| 3,829,542 | 8/1974 | DeRomano | 264/71 |
| 3,869,295 | 3/1975 | Bowles | 106/111 X |

*Primary Examiner*—Thomas P. Pavelko
*Attorney, Agent, or Firm*—Cushman, Darby & Cushman

[57] ABSTRACT

When producing insulating units, in particular building units, plaster of Paris was previously poured into the mold, bloated polystyrene pearls being prekneaded into said plaster. Plaster of Paris has also been poured into molds, wherein a lining of an aggregate of fused, bloated polystyrene pearls were prearranged. The bloated polystyrene pearls according to the invention are first densely packed in the mold, whereupon plaster of Paris, cement or another hydraulic binding material is filled into the mold through a net or a perforated plate, said net or perforated plate keeping the pearls densely packed during the casting so as to ensure that they do not reposition as a consequence of their buoyancy in the cast, liquid binding material.

25 Claims, 4 Drawing Figures

Fig.1
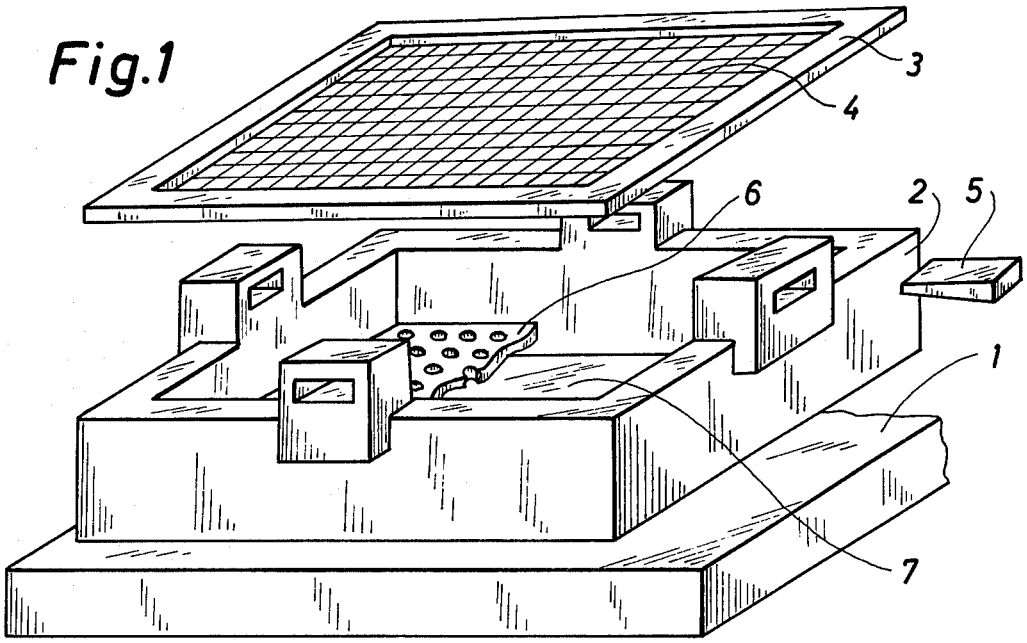
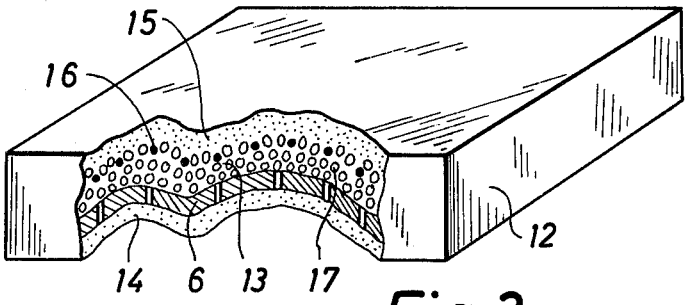
Fig.2
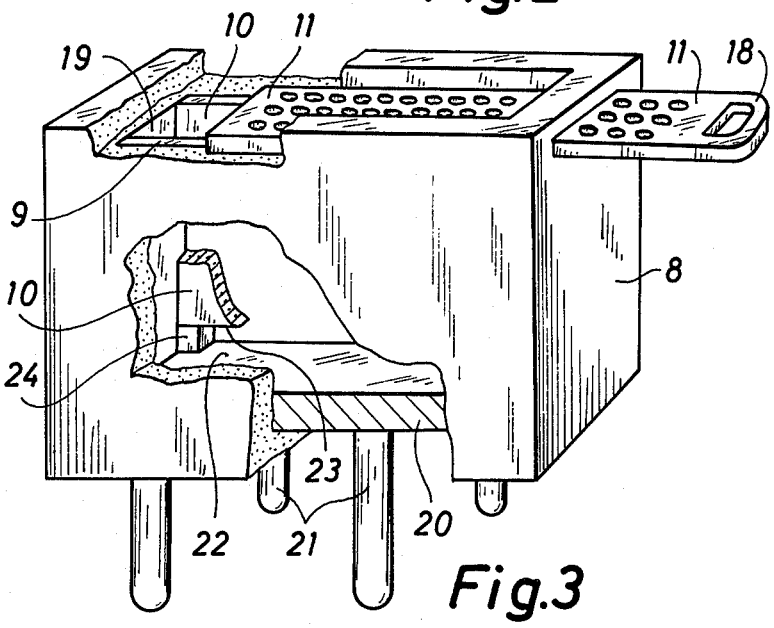
Fig.3
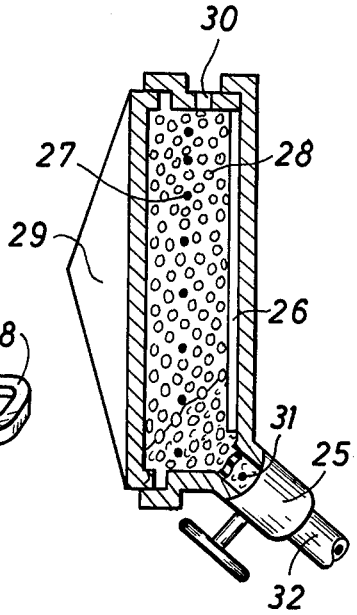
Fig.4

METHOD AND A MOULD FOR PRODUCING AN INSULATING UNIT, IN PARTICULAR A BUILDING UNIT

It is known to manufacture insulating units, in particular building units of a binding material, e.g. of cement or plaster of Paris, which in a coherent phase surrounds expanded, polymeric grains of the size ½ to 15 mm and of a low volume weight, preferably polystyrene pearls having a volume weight of 0.01 to 0.04 grams per cubic centimeter.

Before the casting in a mold the grains are kneaded into the binding material, and thus the completed unit obtains a volume weight considerably lower than that of a corresponding plate made of a solid binding material.

Since the number of pearls kneadable into the binding agent is limited whether the binding material is plaster of Paris or cement mortar, it has been necessary to foam the binding material to further reduce the weight of the building unit by adding some surfactants, whereby very small gas blows in the binding agent are chemically produced. What the completed product gains in lightness is, however, lost with regard to the fire retardant properties because the thin walls of the binding material — left after torrefaction of the plastic influenced by the flames — only possess a low resistance to said flames. Said resistance is reduced since the walls are porous due to the foaming.

The present invention avoids foaming of the binding material, and provides units having a lower volume weight than any of the known units, the units according to the invention preserving the fine fire retardant properties since the volume of the polymeric grains relative to the binding material is increased in a particular manner.

According to the invention the polymeric grains may be arranged so as to be densely packed by means of a net or a screen plate secured to the mold, whilst the binding material having a thin, creamy consistency is poured into the mold to produce a closed-cell matrix round the grains. "Creamy" here means: Having a consistency like cream or thick soup. Having such a consistency the binding material penetrates the grain layer and thereby produces the said matrix having membrane-like walls of unporous binding material and being considerably thinner than the walls of the known plates, in which the grains are prekneaded into the binding agent.

It has been suggested to glue expanded thermoplastic resin pearls, and to arrange the glued unit as a lining in a mold. This mold is subsequently filled with a hydraulic binding material penetrating the interstices between the pearls before it sets. However, since said penetration is very defective, the result is apparently a light unit with very defective fire retardant properties, because the heat of a fire may be quickly transmitted from one pearl to another, and because the pearls melt away quickly at 115° to 150° C.

It is according to the invention preferred to use a hydraulic binding material such as plaster of Paris, said binding material particularly ensuring the formation of a closed-cell matrix since the buoyancy of the pearls separates the pearls from each other during the pouring in of the binding material, whereby the plaster of Paris flows into the interstices between said pearls. This is very important since a complete or almost complete embedding of the pearls in a binding material increases the fire retardant properties considerably, because hot air and flames cannot be transmitted from pearl to pearl before an intermediate wall of plaster of Paris is burnt away.

According to the invention 8 to 30, preferably 20 to 25 percent by volume of dry plaster of Paris may be added to the expanded grains. Thus a considerably saving in plaster of Paris is obtained compared to the known units.

Furthermore according to the invention it is preferred to shake or vibrate the mold during or after the pouring out of the binding material to ensure that the binding material penetrates to the grains at the bottom of the grain layer and that air pockets, if any, are removed. Such a shaking not only improves the penetration of the binding material through the grains, but also ensures that the binding material sinks down between the grains to produce the membrane-like walls, as well as it ensures that air pockets, if any, are removed.

According to the invention the grains may be pressed so much together in the mold that only so much space is left for the binding material that the binding material when poured under pressure can penetrate the grain layer to produce a closed-cell, strong and fire retardant matrix. Thereby the completed unit obtains an optimum strength and resistance to flames as well as insulating properties and a light weight.

The above properties of the unit are improved according to the invention by using well-premixed, expanded polystyrene pearls of two size fractions, the first of 66 percent by volume pearls being 8 to 15 mm in diameter and the second of 34 percent by volume pearls being 3 to ½ mm in diameter so as to ensure an even fineness of the thickness of the cell wall.

According to the invention is is furthermore preferred to pour the binding material — the grains completely expanded and optionally slightly shaken up for instance by a short vibration and deposited in the mold — out between the grains whilst passing it through a net of plastics or steel wire pressing against the pearls, or through a perforated plate such as a screen plate, said net or perforated plate optionally serving as a reinforcing member in the completed unit. The net or the perforated plate thus ensures that the very light grains remain densely packed and do not flow upwards in the mold during the pouring of the binding material. This is to produce a product having a particularly high number of grains in the unit.

Moreover according to the invention the net and its frame may be removed during the setting of the binding material, said net during the pouring operation being stretched out in a rigid frame secured to the mold and pressed firmly against the pearls. In this manner the same net may be used when producing new units. When the net leaves traces in the cast unit, said traces are optionally trimmed or covered by pouring in of a thin layer of binding material. A perforated plate may according to the invention be used instead of the net.

As a general rule the mesh size of the net or the hole size of the perforated plate must be smaller than the diameter of the grains, but in practice nothing prevents the sizes from being somewhat larger since the grains are situated densely packed outside the hole or holes.

According to the invention a net or a screen plate may be stretched out in the mold below the grains, through which net or plate such portions of the binding material forming a grainfree layer on the underside of the unit pass, said net or screen plate furthermore serving as a reinforcing member in the completed unit. In this manner said net or said screen plate has two functions, i.e. a first during the production of the unit and a second during the use of said unit.

Moreover according to the invention reinforcing nets of metal wire or stretched metal may be inserted in the mold before the grains are deposited. The latter material possessing a large surface has proved to be very well suited for reinforcement of this unit. All these types of nets may be situated anywhere in the mold depending on the strength properties desired for the unit.

Furthermore according to the invention a layer impermeable to steam and moisture may be inserted in one side or in the middle of the mold before the grains are deposited, said layer being for instance an asphalt plate or a film of plastics or aluminium, said position depending on the insulating purpose of the unit.

In order to prevent the grains or the pearls from repositioning under still higher pressures as a consequence of their buoyancy in the binding agent and in spite of the pressure produced at the web or the perforated plate, when the pouring of said binding material starts, the pearls may according to the invention be compressed 3 to 15 percent of their total volume before adding the binding material, said compression being somewhat higher than if the pearls had flowed upwards in the mold during the pouring of the binding material.

This compression for the reduction of the volume of the pearls with 3 to 15 percent by volume may according to the invention be produced by moving a piston situated at the bottom of the mold and covering the bottom completely or partly.

By providing the mold with a variable volume it is according to the invention possible to move the piston just so much, that the security desired is exactly obtained against a so heavy reduction of the cross section of the passages between the pearls that the binding material cannot fill the passages completely. This is inter alia owing to occluded air in the often capillary passages.

However, in some cases an extra light plate is desired to the disregard of the fire retardant properties. In such cases the pearls may according to the invention be precompressed in the mold more than 15 percent by volume, whereby a particularly light and well-insulated unit is obtained. In such cases the capillary effect in the passages between the pearls and the hydraulic effect during the setting are insufficient, whereby the binding material cannot penetrate completely between the contact surfaces of the pearls and separate said pearls completely. Consequently, the completed unit has a higher percent by volume of pearls and consequently a higher insulating capacity.

Units produced according to the invention are homogeneous and isotropic.

Some molds may as a consequence of their spacious extent involve particular difficulties in pressing the air out, whereby the above difficulties with occluded air arise. According to the invention a vacuum may be produced in the mold after depositing the grains, whereupon the binding material is fed through a valve, i.e. a predetermined vacuum is still present in the mold. This vacuum not only reduces the amount of air but also presses out the remaining air pockets. Admittedly the pearls simultaneously expand somewhat as a consequence of the inner pressure in their pores or blisters, but simultaneously they yield more to the penetrating binding material.

In other cases when the mold has another shape it is according to the invention preferred to feed the binding material under pressure from the bottom of the mold during "increasing" moulding. This method is also very well suited for avoiding air pockets forming cavities not desired in the produced unit. Such cavities are particularly undesired when they appear on the surface of the completed unit.

When it is a question of producing a unit, e.g. a building unit, it is advantageous to use a so-called "increasing" moulding, and according to the invention it is preferred to position the rectangular mold in such manner that a corner turns downwards and its side edges incline about 45° with horizontal plane, whereupon the mold is filled with binding material from the lower portion of the mold cavity.

The guarantee for a bottom layer of pure binding material by arranging a fine-meshed web below the pearls has been described previously, said layer providing an even, uniform underside of the produced unit.

When it is a question of producing a planar unit, it is often desired that at least one side is even, i.e. without pearls. In this case it is according to the invention preferred to turn the mold for a planar unit into a horizontal position, after being filled with binding material when in a vertical position, as soon as the setting has started, whereby a thin, grainfree layer on the new underside is formed, said layer having an even surface without visible grains after removing the unit from the mold. The grains originally deposited in said side of the mold have disposed somewhat upwards due to the bouancy, whereby the binding material may penetrate below said grains to form the even, uniform surface.

When it is desired that other surfaces of the unit are even and uniform, the binding material may be post-cast thereon. A planar unit without visible grains on any of its sides may according to the invention be produced by turning the mold for a planar unit completely over as soon as the setting is to start, the mold being positioned horizontally during the concreting, whereby a grainfree layer on the new underside is formed, and thus both side surfaces of the unit get an even surface without visible grains, and the wall is nailable, i.e. it can be nailed or glued to an existing inner wall. In this manner the securing of units to the plate is also facilitated.

A mold for carrying out the method according to the invention is characterized by having a detachable, stretched out net or perforated plate pressing firmly against the grains during the concreting of the binding material. This net or this perforated plate may be used a great many times and are easy to arrange and detach.

The drawing illustrates a perspective view of three embodiments of the mold according to the invention.

FIG. 1 illustrates a horizontal opened mold,

FIG. 2 a plate unit cast by means of the mold of FIG. 1,

FIG. 3 a vertical mold being prepared for pouring, and

FIG. 4 a vertical sectional view through a mold resting on one corner during the pouring.

FIG. 1 shows a mold frame 2 situated on a vibrating table 1. A polyethylene net 4 stretched out in a frame 3 is secured to said mold frame 2 by means of wedges 5, only one wedge appearing from the drawing.

Just before situating the net the mold 2 is filled with a grainy material in form of a layer of ½ to 6 mm of polystyrene pearls with a volume weight of about 0.015 grams per cubic centimeter, said mold having a detachable bottom 7. Subsequently a thin, creamy binding material of free-flowing plaster mortar is poured through the meshes of the net 4, optionally during vibration of the table 1. During said vibration the net 4 positions the pearls densely packed in the mold, and the vibration ensures that the plaster mortar flows between the pearls thus separating said pearls by membrane-thin walls. In this manner the plaster produces a closed-cell matrix round the grains.

Since the grains are densely packed in the completed unit, such a unit is far lighter than known units of plaster, the latter having a volume weight of 1.2 grams per cubic centimeter in contrast to the inventive unit having a volume weight of about 0.26 grams per cubic centimeter. The unit possesses excellent fire retardant properties in spite of the very low plaster content. When influencing a 6 cm thick wall by flames from a Bunsen burner for 1½ hour, only 3 cm of the wall burnt away, whereas the temperature of the other side of the wall opposite the burning spot did not increase perceptibly. The fire retardant properties of the plate fulfil the claims concerning surface fire retardant properties prescribed for a coating of Class 1, since the plate stood both the SFTM 4-and the SPA 8 tests.

The insulating properties of the plate are also far better than the properties of the plaster plate, and the above unit is far more insulating than porous concrete. The coefficient of thermal conduction of the unit is about 0.053 kcal/m h° C.

Adjacent the bottom of the mold 2 a screen bottom 6 or a fine-meshed net is inserted keeping a small area in the bottom of the mold free from grains when said grains are deposited in the mold. In this manner an insulating building unit 12 is produced, cf. FIG. 2, having a central layer 13 with many grains, said layer being surrounded by a layer 14 of pure plaster formed in the bottom of the mold frame and by a second layer of pure plaster 15 poured out into the upper portion of the mold after removal of the net 4. The unit 12 furthermore comprises a coarse-meshed net 16 of metal inserted as a reinforcing member. This net may be inserted in the mold both before and after the situating of the pearls 17, since these pass the meshes of the net 16 without difficulty.

A light, high early-strength cement mortar containing one part by weight of cement per 0.4 to 0.5 parts by weight of water was poured into a mold — of the type illustrated in FIG. 1 but without the screen bottom 6 — and over a layer of expanded polystyrene grains with a diameter of no more than 10 mm, said grains being kept densely packed by a net 4. The cast unit had a volume weight of about 0.4 grams per cubic centimeter, and its fire retardant properties were better than the properties of the unit according to the above Example.

The casting of the unit in a vertical mold 8, cf. FIG. 3, implies that a great many units may be produced at the same time by arranging the molds side by side. Millboards 9 and 10 may be inserted in the mold before depositing the grains, whereby said millboards are cast to the unit.

The plates also strengthen and preserve the unit as well as they increase the nailability in a known manner. A screen bottom 11 with a handle 18 is disposed over the mold cavity 19. Subsequently, the mold is filled with polystyrene pearls of two size fractions, i.e. one of 66 percent by volume with a diameter of 12 mm and a second of 34 percent by volume with a diameter of 2 mm. The pearls are thoroughly mixed before being deposited in the mold. Subsequently, a piston 20 with piston rods 21 situated at the bottom of the mold is pressed upwards in the mold until the pearls are pressed to about 88 percent of their original volume in the mold, whereby the surface 22 of the piston reaches the lower edge 23 of the millboards 9 and 10. The plate 10 rests on a block 24 in the mold cavity. The piston 20 moves about said block 24, since it comprises quadrangular recesses in its corners corresponding to the shape of the blocks 24.

FIG. 4 illustrates a mold resting on one corner, by which mold the casting takes place through a valve 25 at the lowest corner of the mold. In one side of the mold an asphalt plate 26 impermeable to moisture and steam is inserted, and a coarse-meshed net 27 is inserted in the middle of the mold. Subsequently, the mold is filled with polystyrene pearls 28, and the detachable side wall 29 of the mold is pressed down over these pearls in order to close the mold. Air may slip away through a hole 30 in the upper corner of the mold as the plaster soup 31 is fed to the mold through the bottom. FIG. 4 illustrates a mold a tenth filled with plaster 31.

This plaster may be fed under pressure from a plaster container (not shown) movable in the vertical direction and connected to the mold via a wire 32. It is, however, also possible to connect a suction line to the hole 30 and thus suck the liquid plaster up into the mold.

Other binding materials may be used instead of plaster of Paris. For outdoor units it is preferred to use cement as binding material, but other mortars may also be considered.

I claim:

1. A method of producing an insulating unit which is a matrix of a hydraulic binding material in which is embedded expanded, polymeric granules, comprising disposing said granules of a size of 0.5 to 15 mm and of a density of 0.01 to 0.04 grams per cubic centimeter into a mold to fill at least a part of the mold and densely packing the granules therein;

maintaining said granules in a densely packed state in said mold by disposing over the top of said granules a net or a screen plate which is secured to the mold; and, while said granules are maintained in said densely packed state, pouring said binding material, having a thin creamy consistency into the mold to produce a closed-cell matrix about said granules.

2. A method as claimed in claim 1, wherein said hydraulic binding material is plaster of Paris, said hydraulic binding material particularly ensuring the formation of a closed-cell matrix since the buoyancy of the granules separates the granules from each other during the pouring in of the binding material, whereby the plastic of Paris flows into the interstices between said granules.

3. A method as claimed in claim 1, characterized by adding 8 to 30, preferably 20 to 25 percent by volume of dry plaster of Paris to the expanded granules.

4. A method as claimed in claim 1, characterized by shaking or vibrating the mold during or after the pouring out of the binding material to ensure that the binding material penetrates to the granules at the bottom of the granules layer and that air pockets, if any, are removed.

5. A method as claimed in claim 1, characterized by pressing the granules together in the mold that only so much space is left for the binding material that the binding material when poured under pressure can penetrate the granules layer to produce a closed-cell, strong and fire retardant matrix.

6. A method as claimed in claim 1, characterized by using well-premixed, expanded polystyrene pearls of two size fractions, the first of 66 percent by volume pearls being 8 to 15 mm in diameter and the second of 34 percent by volume pearls being 3 to ½ mm in diameter so as to ensure an even fineness of the thickness of the cell wall.

7. A method as claimed in claim 1, characterized by pouring the binding material the granules being completely expanded, out between the granules whilst passing it through a net of plastics or steel wire pressing against the granules, or through a perforated plate such as a screen plate, said net or perforated plate optionally serving as a reinforcing member in the completed unit.

8. A method as claimed in claim 7, characterized by removing the net and its frame during the setting of the binding material, said net during the pouring operation being stretched out in a rigid frame secured to the mold and pressed firmly against the granules.

9. A method as claimed in claim 7, characterized by pressing the perforated plate secured to the mold against the granules during the pouring operation.

10. A method as claimed in claim 1, characterized by the portions of the binding material forming a granule-free layer on the underside of the unit passing through a net or a screen plate stretched out in the mold below the granules, said net or screen plate furthermore serving as a reinforcing member in the completed unit.

11. A method as claimed in claim 1, characterized by inserting reinforcing nets of metal wire or stretched metal in the mold before the granules are deposited.

12. A method as claimed in claim 1, characterized by inserting reinforcing nets of plastics in the mold before the granules are deposited.

13. A method as claimed in claim 1, characterized by inserting reinforcing nets formed as coarse-meshed glass wool webs in the mold before the granules are deposited.

14. A method as claimed in claim 1, characterized by inserting a layer impermeable to steam and moisture in one side or in the middle of the mold before the granules are deposited, said layer being for instance an asphalt plate or a film of plastics or aluminium.

15. A method as claimed in claim 1, characterized by compressing the pearls 3 to 15 percent of their total volume before adding the binding material, said compression being somewhat higher than if the granules had flowed upwards in the mold during the pouring of the binding material.

16. A method as claimed in claim 1, characterized by reducing the mold content 3 to 15 percent by volume after adding the binding agent.

17. A method as claimed in claim 1, characterized by precompressing the granules in the mold more than 15 percent by volume, whereby a particularly light and well-insulated unit is obtained.

18. A method as claimed in claim 1, characterized by producing a vacuum in the mold after depositing the granules whereupon the binding material is fed through a valve.

19. A method as claimed in claim 1, characterized by feeding the binding material under pressure from the bottom of the mold during "increasing" moulding.

20. A method as claimed in claim 19, characterized by positioning the rectangular mold in such manner that a corner turns downwards and its side edges incline about 45° with horizontal plane, whereupon the mold is filled with binding material from the lower portion of the mold cavity.

21. A method as claimed in claim 1, characterized by turning the mold for a planar unit into a horizontal position, after being filled with binding material when in a vertical postion, as soon as the setting has started, whereby a thin, granule-free layer on the new underside is formed, said layer having an even surface without visible granules after removing the unit from the mold.

22. A method as claimed in claim 1, characterized by turning the mold for a planar unit completely over as soon as the setting is to start, the mold being positioned horizontally during the concreting, whereby a granule-free layer on the new underside is formed, and thus both side surfaces of the unit get an even surface without visible granules.

23. The method of claim 1, wherein said granules are polystyrene pearls.

24. The method of claim 1, wherein said hydraulic binding material is cement or plaster of Paris.

25. A method as claimed in claim 1, wherein an asphalt plate or a film of plastic or aluminum is disposed in the middle of the mold before the granules are deposited.

* * * * *